United States Patent [19]

Mengeringhausen

[11] Patent Number: 4,501,052

[45] Date of Patent: Feb. 26, 1985

[54] METHOD OF MANUFACTURING CANTILEVERED COMPOSITE STRUCTURE

[76] Inventor: Max Mengeringhausen, Steinachstr. 5, 8700 Würzburg, Fed. Rep. of Germany

[21] Appl. No.: 445,107

[22] Filed: Nov. 29, 1982

[30] Foreign Application Priority Data

Nov. 27, 1981 [DE] Fed. Rep. of Germany ..... 8134667

[51] Int. Cl.[3] ..... B23P 17/00

[52] U.S. Cl. ..... 29/155 R; 29/460; 29/469.5; 52/449

[58] Field of Search ..... 29/155 R, 417, 469.5, 29/460; 52/73, 319, 336, 368, 449, 673, 674, 675, 724, 728, 630, 795

[56] References Cited

U.S. PATENT DOCUMENTS

| | | | |
|---|---|---|---|
| 1,432,567 | 10/1922 | Pratt | 52/673 X |
| 2,233,719 | 3/1941 | Vanderveld | 29/155 R |
| 2,986,193 | 5/1961 | Howell | 29/155 R X |
| 3,004,324 | 10/1961 | Macomber | 29/155 R |
| 3,470,598 | 10/1969 | Berthelsen | 29/155 R |
| 3,540,116 | 11/1970 | Drohos | 29/469,5 X |
| 3,650,144 | 3/1972 | James | 29/469.5 X |
| 3,960,639 | 6/1976 | Kudo | 29/469.5 X |

*Primary Examiner*—Charlie T. Moon

*Attorney, Agent, or Firm*—Jacobi Siegel Presta Marzullo & Aronson

[57] ABSTRACT

The invention relates to a cantilevered composite structure plate for double floors, decks, roofs or the like, with a trough serving as outside reinforcement and made of a material with high tensile strength and high elasticity module, preferably sheet steel, and a filler material of low tensile strength and low elasticity module, e.g., anhydrite or concrete, placed in the hollow of the trough, and also with an armature in the trough floor, preferably in the form of funnel-shaped holes. The trough is formed with masses of the strong material being provided on the bottom of the trough floor in the form of substantially parallel, downwardly extending, flex-resistant rods that are disposed in substantially perpendicular relation to the trough floor.

2 Claims, 12 Drawing Figures

FIG. 5
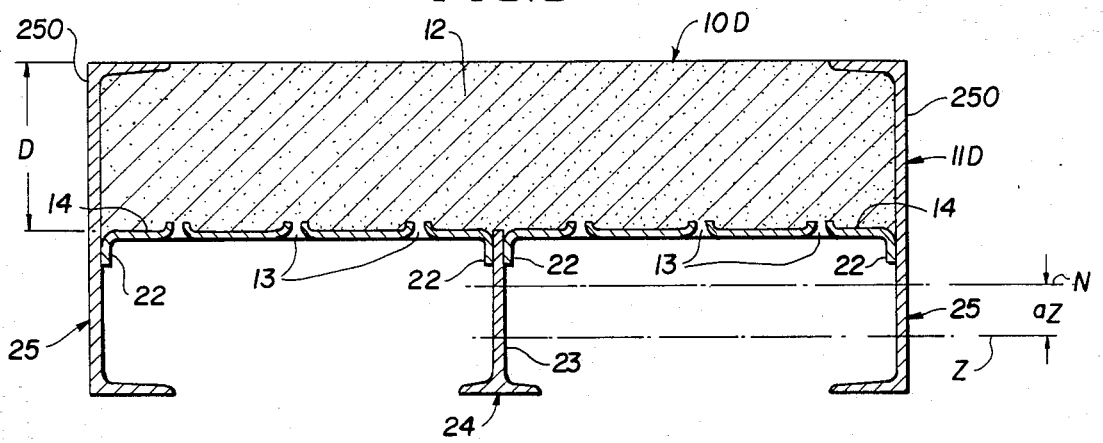
FIG. 6A
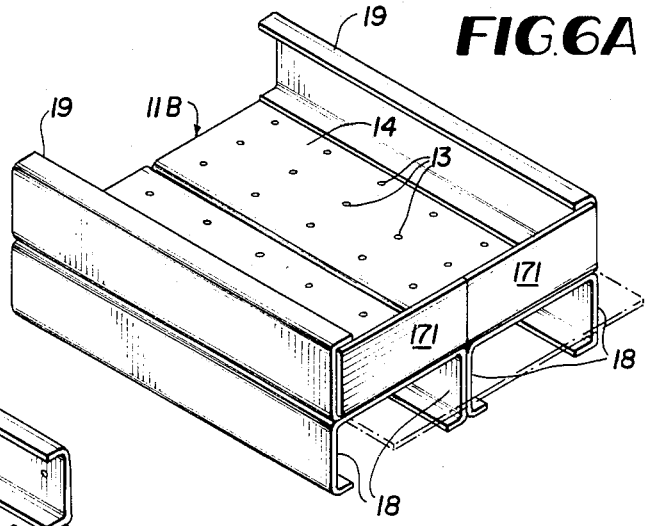
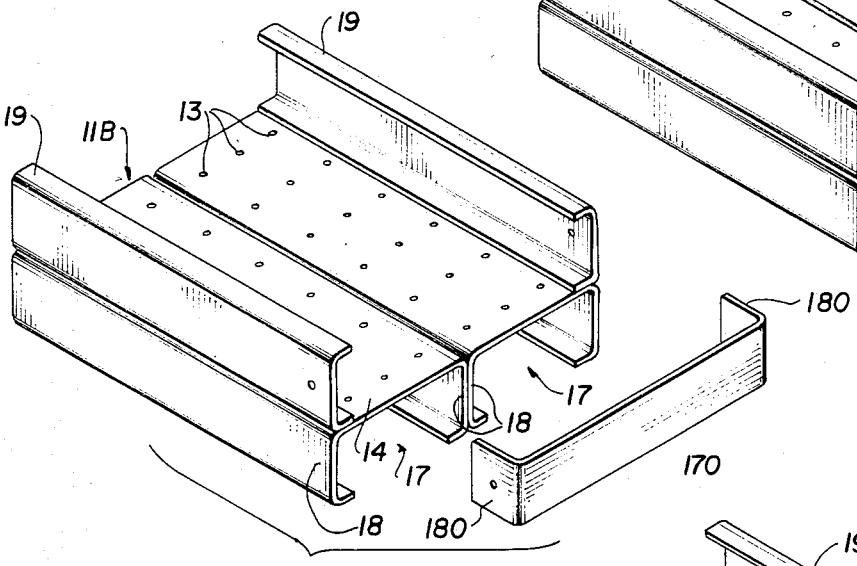
FIG. 6B
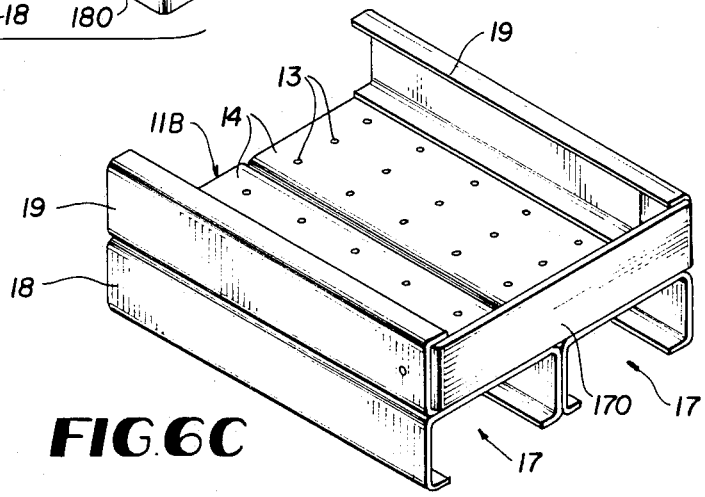
FIG. 6C

FIG.7
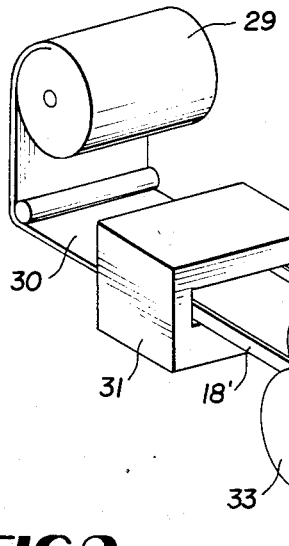
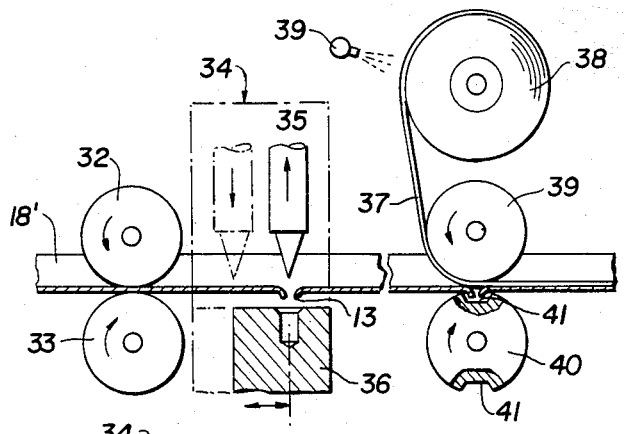
FIG.8
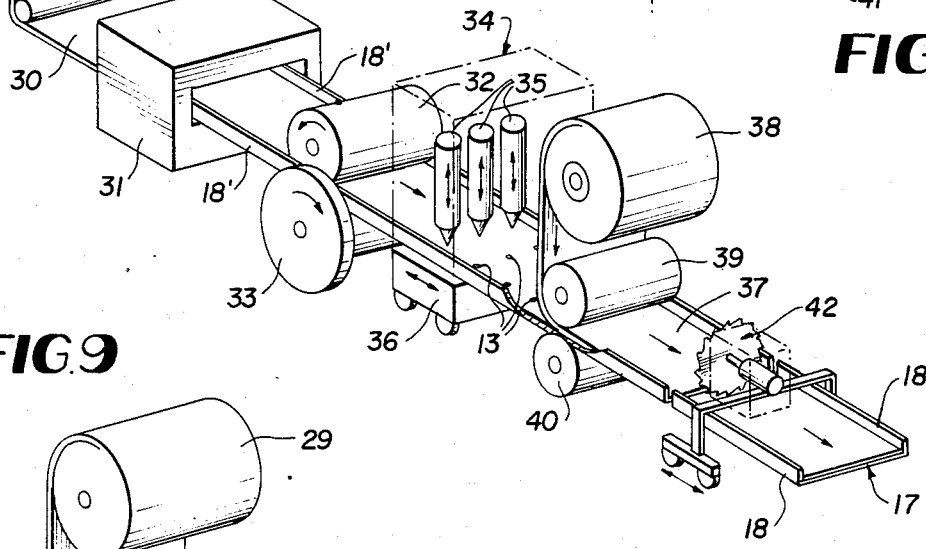
FIG.9
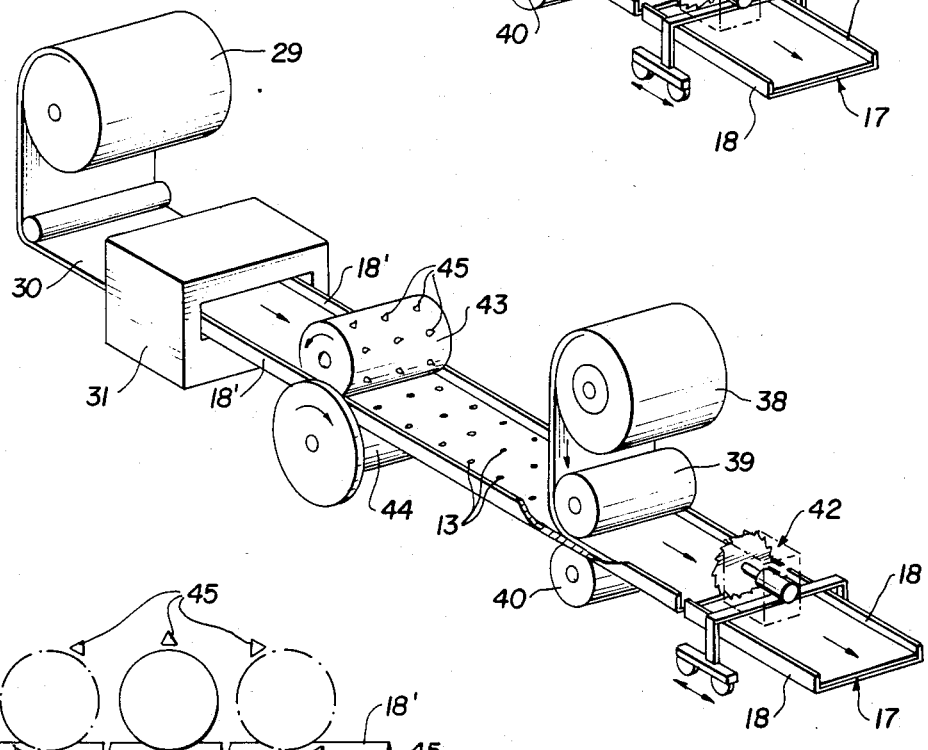
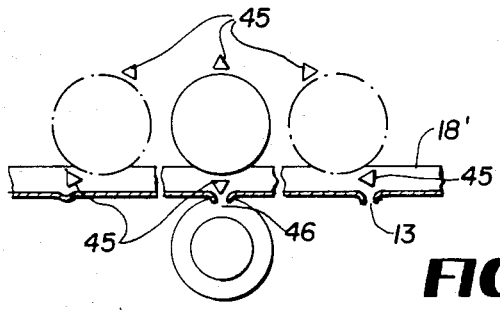
FIG.10

METHOD OF MANUFACTURING CANTILEVERED COMPOSITE STRUCTURE

BACKGROUND OF THE INVENTION

The invention relates to a cantilevered composite structure plate for double floors, decks, roofs or the like, with a trough serving as outside reinforcement and made of a material with high tensile strength and high elasticity module, preferably sheet steel, and a filler material of low tensile strength and low elasticity module, e.g. anhydrite or concrete, placed in the hollow of the trough, and also with an armature in the trough floor, preferably in the form of funnel-shaped holes, and the invention also relates to a process for the manufacture of such composite structure plates.

A similar composite structure plate has been disclosed by the DE-PS No. 2004101. In this embodiment, the trough serving as outside reinforcement is generally of sheet steel in square shape, manufactured by deep-drawing, whereby the essentially smooth-surfaced trough floor overlaps on all four sides onto the perpendicular walls. It is also known to impress stiffening corrugations therein in cross arrangement, to stiffen the trough floor. Such deep-drawn troughs, however, are relatively expensive to manufacture and require deep-drawing as well as static ratios of the finished composite structure plates requiring rather thick-walled metal sheets for the troughs, which further increases the cost. The statically neutral plane in this known composite structure plate lies at only a relatively small distance over the trough floor in the filler material of low tensile strength and low elasticity module. This means that the leverage between the statically neutral plane or zone and the trough floor which is serving as outside reinforcement is very small relative to the thickness of the filler material, and thus requires a correspondingly thick trough floor. This is also one of the reasons why this plate construction cannot be used efficiently over a large span width or length. In addition, troughs cannot be efficiently manufactured with large and variable dimensions in the deep-drawing process.

Similarly, the ratios in the structural plate are disclosed by the DE-PS No. 1 609 740, in which the side walls of the trough are provided with an edge outside the weaker material found in the hollow space of the trough, which should prevent e.g. buckling of the side walls of the trough during filling of the weaker material. This patent specification also shows an embodiment in which the smooth trough of strong material is used as cover plate, with insertion of a weak layer in a corresponding superstructure trough of strong material. Thus, a particularly rigid plate is obtained which must bear heavy flex stresses, which however requires two deep-drawn troughs, and thus is still more expensive than the above composite structure plate. This construction is practically not at all suitable for large span widths or lengths.

A sheathing plate is also disclosed in DE-AS No. 21 50 959, serving as reinforcement for a concrete covered deck formed of sheet metal (hidden sheathing), which has parallel rods of different cross sections, anchored in the concrete layer, which give the sheathing plate a resistance and inertia moment sufficient for the installation. These constructions, however, cannot be simply switched over to cantilevered composite structure plates of the above type with outside trough-like reinforcement.

SUMMARY OF THE INVENTION

With composite constructions consisting of steel in the lower chord and concrete in the upper chord, it is generally known to place the steel parts under the greatest stress at as great as possible distance from the statically neutral plane. The present invention uses these measures on a cantilevered composite structure plate of the above described construction, in order to increase its resistance moment, whereby it can also be manufactured in variable dimensions and for great span widths or lengths.

According to the invention, this is attained in that the trough of desired dimensions is assembled of profile parts in strips and masses of the strong material in the form of flex-resistant rods or ribs, running parallel to each other and projecting perpendicularly or almost perpendicularly downward, on the underside of the trough floor.

Thus the statically neutral plane is found either in the trough floor or beneath the trough floor itself. At the same time, the outermost fibers of the flex-resistant rods or ribs which are under stress are moved further from the neutral plane, and the distance of the resultants of the traction forces of the statically neutral plane is many times greater than with the above known composite structure plate. As a result of these measures, using only relatively thin-walled sheet metal material for the trough, one attains a composite structure plate with relatively great inertia moment and resistance moment. For the practical effect of the invention, it is also very important that troughs of the desired dimensions can be assembled of profile parts in strips, which can be manufactured efficiently and therefore at low cost e.g. by roll deformation of smooth strip material which is already manufactured and available. Expensive, deep-drawn troughs, as in the present state of the art, are thus avoided with the invention.

When two facing side walls of the trough are mounted on the shanks of the inverted trough-shaped sheet metal profile element(s), it is advantageous that the outermost, downward-pointing, flex-resistant rods or ribs of the composite structure plate be reinforced or further stiffened, whereupon also the inertia and resistance moment of the finished composite structure plate is even further increased.

Another configuration of the invention is characterized in that the two facing side walls of the trough and the trough floor with the flex-resistant rods are of one piece. This transverse cross section shape e.g. can be attained by roll deformation of a suitable strip of material, and then to finish the trough, only two end walls of the trough need to be assembled.

According to still another configuration of the invention, it is also possible to manufacture the two facing walls of the trough from the parts bent away from the trough floor, which are the strip-shaped profile parts. This variation then allows a trough of one basic element to be manufactured, including the bottom flex-resistant rods and ribs, at low cost and from the strip-shaped profile parts.

One special advantage of the process resides in that one trough basic element, consisting of the trough floor and at least two downward-pointed, flex-resistant rods or ribs of strip material (sheet steel), can be manufactured by roll deformation in a continuous work process.

It is thus essential that different length inverted trough-shaped metal profile pieces be manufactured with the same transverse cross section profile, which are to be added from the side as needed. Thus it is possible to manufacture troughs in the simplest manner for different length and width composite structure plates with rectangular ground plan on the assembly line in a continuous assembly-line operation. Thereby it is possible to use the different work processes in assembly line one after the other without intermediate manual transport, and thus without loss of time. Also, the making of the important holes (armatures) in the trough floor as well as their outside shutting off by an adhering foil and the filling of the trough with the flowable or loose and also hardenable filler material can thereby be incorporated. A higher degree of automation is thus produced, which allows for the greatest efficiency in relatively small space for the manufacturing assembly. Finally, at the conclusion of the manufacturing process, i.e. after the filling process, a drying process can be carried out, in order to accelerate the hardening of the filler material. For this purpose, the troughs could be slowly transported carrying the filler material on a conveyor belt through e.g. a continuous furnace.

BRIEF DESCRIPTION OF THE DRAWINGS

The invention will be explained hereinafter relative to the drawings of some exemplary embodiments. They show:

FIG. 5, a cross section of another version of the composite structure plate;

FIGS. 6A–6C, different three-quarter views of parts respectively of composite structure plates corresponding to the right half of FIG. 3, which show two possibilities for closing the open ends of the trough;

FIG. 7, a diagrammatic three-quarter view of a manufacturing assembly for a trough-shaped profile with holes, of which the separate pieces form the trough floor either individually or in a plurality;

FIG. 8, a diagram of a part of the manufacturing assembly as in FIG. 7 in the area of the punch device to punch the holes in the floor of the trough-shaped profile;

FIG. 9, a three-quarter view of the manufacturing assembly diagrammatically similar to FIG. 7, with a modified punch device, and FIG. 10, a diagrammatic side view of the modified punch device of FIG. 9 from the side, showing different work phases in the production of the holes in the floor of the trough-shaped profile.

DESCRIPTION OF THE PREFERRED EMBODIMENTS

Figure 1:
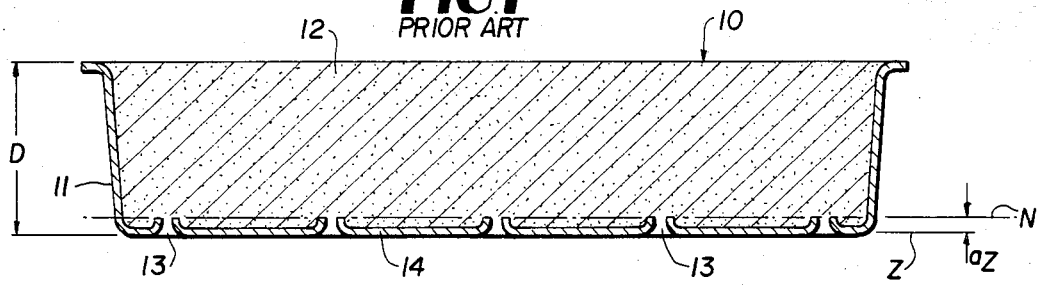
FIG.1 PRIOR ART
FIG. 1, a cross section of a composite structure plate which corresponds to the present state of the art, as explained above.

The composite structure plate 10 in FIG. 1, corresponding to the state of the art, includes a rectangular trough 11 of sheet steel, manufactured by deep-drawing, for outside reinforcement, of which the hollow space is filled with a filler material 12, e.g. anhydrite. The pressure-resistant filler material 12 is anchored with trough 11, which is of strong material, essentially by funnel-shaped holes 13 in trough floor 14, which project up inside the floor, into which filler material 12 flows. These funnel-shaped holes 13 form a so-called armature.

The statically neutral plane N in this known composite structure plate 10 lies in pressure-resistant filler material 12 at only a very small distance "az" over trough floor 14 and somewhat over the effective traction line Z in trough floor 14 when composite structure plate 10 is loaded. This means that the leverage (which corresponds to the distance az) between statically neutral plane N and trough floor 14 is very small relative to the thickness of filler material 12. Therefore, this plate construction cannot be manufactured effectively with suitably large dimensions for bridging over large span widths or lengths.

For the composite structure plate according to the invention, particularly for the trough floor, such a shape is selected that the outermost material fibers of the outside trough-like reinforcement which are subject to traction stress and therewith the resultant of the sum of the traction forces is at a many times greater distance az from the neutral plane N than with the known composite structure plate in FIG. 1.

Figure 2:
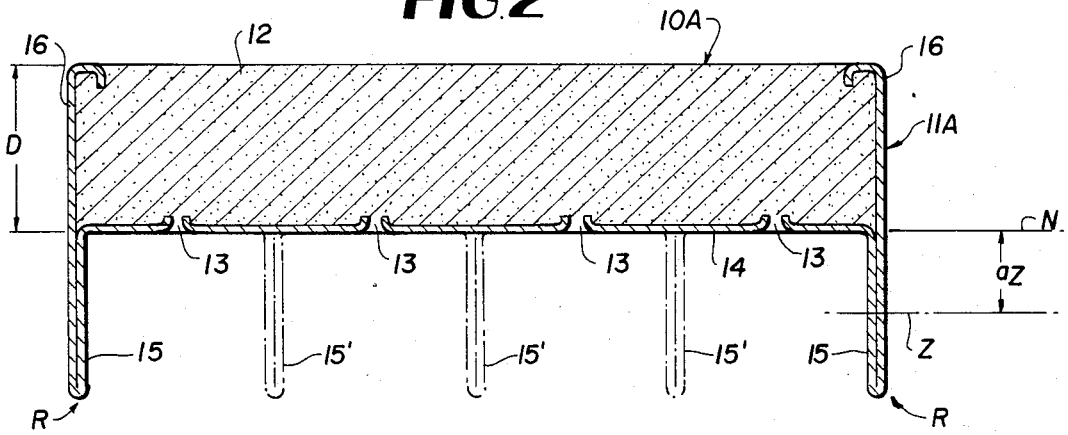
FIG. 2, a cross section of a first embodiment.

The composite structure plate 10A of the first embodiment of the invention corresponding to FIG. 2 has a trough 11A as outside reinforcement for pressure-resistant filler material 12, e.g. anhydrite. The basic substance of trough 11A is one single strip-shaped profile part, which is brought by rolling or roll deformation into the transverse cross section shape shown in FIG. 2. This one-piece trough basic substance includes the trough floor 14, with its funnel-shaped holes 13, wherein flex-resistant rods 15 extend along two opposite outer edges of the trough floor, extending perpendicularly downward. These flex-resistant rods 15 are folded 180° at R all at the same distance from the bottom of the trough floor and then run upward again, whereby the parts of two facing sides 16 projecting upward over trough floor 14 form trough 11A. The walls of trough 11A not shown in FIG. 2 are embodied on the ends of trough basic substance and could e.g. be embodied as in FIG. 6B, which shows a corresponding wall 170 of a strip of sheet metal material with bent flaps 180, by means of which the wall 170 can be welded or screwed or even riveted flush onto (the inside of) side walls 16.

As shown in broken lines in FIG. 2, other parallel and perpendicularly downward-pointing, flex-resistant rods 15' could also be fastened on trough floor 14 by tip-stretching or in some other manner.

The funnel-shaped holes 13, which stand upward from inside trough floor 14, are embedded in filler material 12, e.g. anhydrite, which also fills the hollow spaces of these holes, which thereby serve as armature between the outside reinforcement and the filler material in this and also in all subsequent embodiments.

The statically neutral zone N in this embodiment lies in the area of trough floor 14 and the distance az of the resultants Z of the traction forces of the neutral zone N is a plurality of that shown in FIG. 1. The inertia moment and resistance moment of this composite structure plate 10A and consequently its capacity to carry loads is increased correspondingly. Likewise, trough 11A serving as outside reinforcement can consist of very thin-walled sheet metal. Thus it is assumed that the thickness D of composite structure plate 10 of FIG. 1 and the same sheet metal quality is used.

Figure 3:
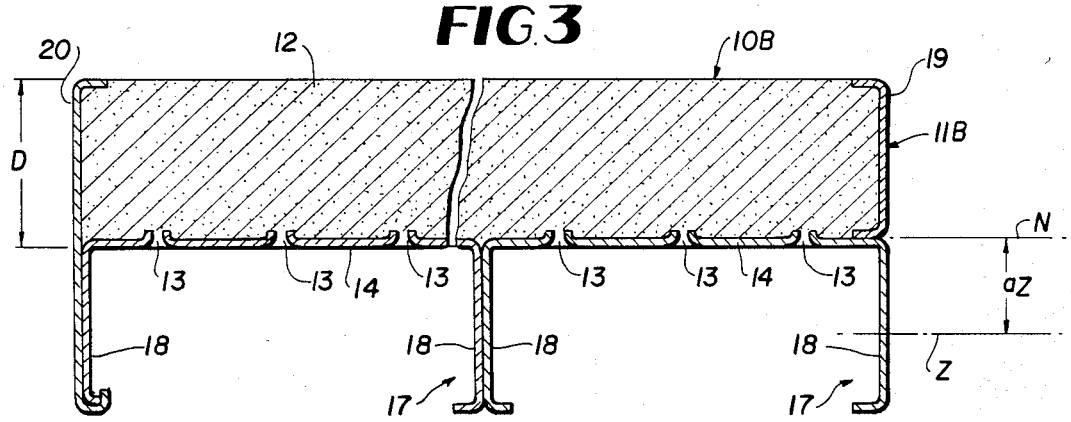
FIG. 3, a cross section of a second embodiment, which shows respectively two variations of the trough, in the left and right halves.

Composite structure plate 10B of FIG. 3 has similar static ratios to those of composite structure plate 10A in FIG. 2. Composite structure plate 10B has a trough 11B for outside reinforcement, to hold pressure-resistant filler material 12, e.g. anhydrite, which trough is assembled of a plurality of profiled parts of e.g. sheet steel in strips. Trough floor 14 with funnel-shaped holes 13 is here formed by a plurality of inverted funnel-shaped sheet metal profile elements 17, which are of the same length and are connected flush with each other on their downward-projecting shanks which impact on one another. This can occur by roll seam welding or point welding, screwing or riveting. The shanks of these trough-shaped sheet metal profile elements 17 here form the downward-pointing, flex-resistant rods 18 of trough 11B. Trough 11B in this embodiment consequently has a multi-part trough floor 14 and the sides of the trough to hold filler material 12 can consist either of a frame of C-profiles 19 or a frame of C-profiles 20 mounted flush on the top of trough floor 14, which are fastened onto the outside shanks or rods 18 of trough-shaped sheet metal profile elements 17. If that is the case, the gaps between the separate parts of trough 11B can be filled simply by strips of glue, in order to avoid leakage of the filler material 12, e.g. anhydrite, which is brought in in flowable state.

Composite structureplate 10C has a trough 11C as outside reinforcement for filler material 12, e.g. anhydrite, which essentially is assembled of the same structural parts as the embodiment shown in FIG. 3. As opposed to the above embodiment, however, here the inverted trough-shaped sheet metal profile elements 17 on their downward-pointing shanks or rods 18 are provided with flanges 21 projecting outward. The trough-shaped sheet metal profile elements 17 are connected one over the other on opposite flanges 21, while the frame constructed of the C-shaped profiles 20 is mounted on the outward-projecting flanges 21 of the outside shanks or rods 18 of trough-shaped sheet metal profile elements 17. In this manner, hollow spaces arise between both the adjacent downward-projecting shanks and the outside shanks and the opposite or facing C-profiles 20 of the surrounding frame, which likewise can be filled with filler material 12. Leakage of the filler material while it is being poured into trough 11C is prevented by C-profile 20 (not shown in FIG. 4) mounted on the end of the surrounding frame.

Figure 4:
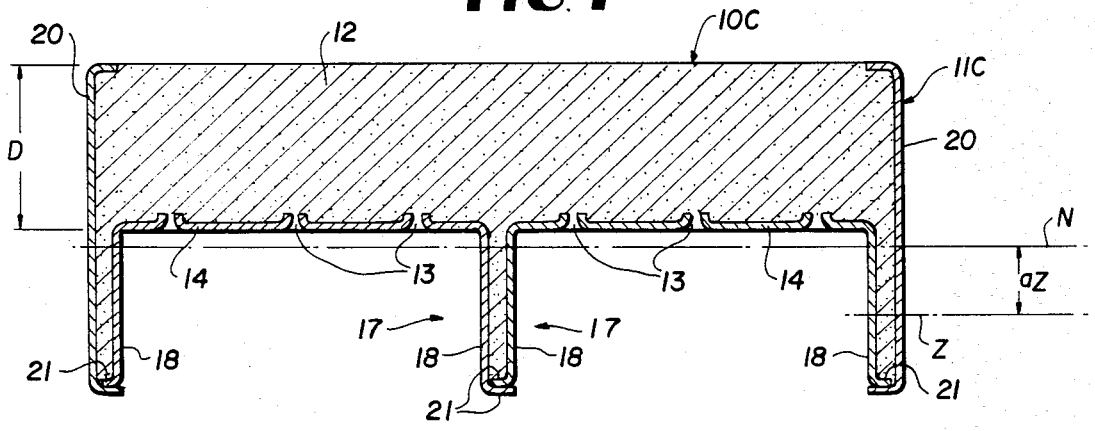
FIG. 4, a cross section of another embodiment of the composite structure plate, in which the flex-resistant rods or ribs provided on the bottom of the trough floor are hollow and contain filler.

Although the statically neutral zone N in the embodiment of FIG. 4 is moved only slightly beneath trough floor 14, the distance az of the resultant Z of the sum of the traction forces of the neutral zone N is considerably larger than that of the known composite structure plate 10 as in FIG. 1. This applies also for the embodiment of FIG. 4. In this composite structure plate 10D, the trough 11D for filler material 12, e.g. anhydrite, serving as outside reinforcement, is assembled from numerous profile parts in strips, as follows:

Trough floor 14 is formed by smooth sheet metal profile elements which are inverted, with their downward-projecting shanks 22 mounted on the rod 23 of an inverted T-profile 24 or on the inside of U-shaped profile 25. The parallel, flex-resistant rods are here formed by rod 23 of T-profile 24 or the perpendicular rods 250 of U-shaped profile 25. It is to be understood that T-shaped profile 24 and U-shaped profile 25 which both have trough-shaped smooth sheet metal profile elements are of the same length and terminate flush on the ends. In a modification of the embodiment of FIG. 4, composite structure plate 10 could span larger widths, by having even three or more inverted, trough-shaped sheet metal profiles arranged adjacent to each other in the configuration of trough floor 14, with insertion of suitable T-shaped profiles 24. The trough hollow space to receive filler material 12, e.g. anhydrite, can be shut off at the ends by walls 170 as in FIG. 6B, which can be mounted by their flaps 180 on the inside of U-shaped profile 25 over trough floor 14.

FIGS. 6A–6C show for example that it is possible to undertake the shutting off of the ends of the trough hollow spaces e.g. by composite structure plate 10B of FIG. 3, right half. The same parts are shown here with the same references. FIG. 6B shows the end wall 170 before incorporation into C-shaped profile 19. A similar wall 170 is provided for shutting off trough 11B on the opposite end. Walls 170, as already explained in connection with FIG. 2, could be mounted flush on the inside of C-shaped profile 19 by means of their bent flaps 180, by point welding, screwing or riveting, so that all four closed sides of trough 11B are open at the top, with trough floor 14. FIG. 6C shows the one end of trough 11B after insertion of wall 170. All of the seams between the individual parts of trough 11B, as explained, could be packed e.g. with strips of adhesive or also with a plastic sealing agent, which could be applied between the individual elements during their assembly.

In the embodiment of FIG. 6A, both end walls of trough 11B are formed by a part which is turned up as a flap from trough floor 14, and therefore connected with these in one piece. Since trough floor 14 in this version consists of the two trough-shaped, inverted, sheet metal profile elements 17, here it is necessary that the projecting parts of both corresponding floors of the trough-shaped sheet metal profile elements (in FIG. 6A on the one end of the trough-shaped sheet metal profile element 16 shown in broken line), be turned upward. The sides of the trough hollow space in the embodiment of FIG. 6A are therefore formed by opposite side walls 19 of C-shaped profiles and the two facing walls 171.

In all of the embodiments, troughs 11A–11D are filled after completion with a flowable or loose hardenable filler material, preferably anhydrite, and even with an excess of filler material. This excess filler material is then removed through holes 13 by being pressed out through them and being scraped off, whereby the filler material is brought to the trough level. The filler material is then left to harden. This hardening process can be accelerated by application of heat.

In all cases, funnel-shaped holes 13 in trough floor 14, serving as armatures, carry the horizontal thrust forces between trough floor 14 and filler material 12.

Troughs 11A–11D can be embodied with outside edges of the same length for the manufacture of quadratic composite structure plates. On the basis of their construction, however, they are particularly suitable when constructed of strip-shaped profile elements with flex-resistant, parallel rods on the trough floor, for rectangular ground plans which are longer than they are wide.

FIGS. 7 and 8 or 9 and 10 are diagrams of two manufacturing assemblies forming trough-shaped sheet metal profile elements 17 by means of strips of material, e.g. sheet steel, with holes 13, which form perpendicular downward-pointing flex-resistant rods 18 (FIG. 3) in and of the trough floor 14 material or with added pieces. The strip material 30 drawn from a roll 29 is first fed into a roll deformer 31, which forms shanks or flanges 18' turned upward at a right angle on both longitudinal edges of strip material 30. Two transport rollers 32, 33 transport strip material 30 continuously in the direction of the arrow. Strip material 30 runs between these rollers with the bent shanks 18' on the longitudinal edges (as a trough-like profile). A punch device 34 is series-connected to these transport rollers 32, 33 in the direction of movement of the trough-shaped profile, which is moved back and forth axially over strip material 30 or its trough-shaped profile. With the synchronous forward movement of punch device 34 together with the trough-shaped profile, funnel-shaped holes 13 are punched out by punches 35 in the floor of the trough-shaped profile, of which only three are shown for example in FIG. 7. The punch 35 for this purpose works with a matrix 36 found beneath the trough-shaped profile, which runs back and forth together with punch 35. In the direction of movement of the trough-shaped profile behind punch device 34 is found a foil 37 glued onto the floor of the trough-shaped profile between shanks 18', the foil being e.g. aluminum foil, which is drawn from a roll 38. The foil 37 is provided with adhesive by a spreading roller 39 before being assembled with the trough-shaped profile. Foil 37 provided with adhesive is pressed by a pressure roller 39 against the bottom of the trough-shaped profile. Pressure roller 39 works together with a counter-roller 40, which has notches 41 to adapt to funnel-shaped holes 13. This foil 37 serves among other things to close funnel-shaped holes 13, so that later, when trough-shaped sheet metal profile elements 17 form trough floor 14, the fluid filler material does not escape through the trough floor. In a correspondingly modified configuration, this foil 37 can also serve to increase the sound insulation and/or fireresistance in the finished composite structureplate.

Finally, a separator device 42 follows further on in the movement direction of the trough-shaped profile, moved back and forth similar to the punch device 34. Separation device 42 makes the separating cut in synchronous movement with the trough-shaped profile, in order to separate profile elements 17 of exact lengths from the trough-shaped profile. Trough-shaped profile elements 17 which are thus formed are then used individually or in a plurality one after the other in series and connected with each other by their shanks to form a trough floor 14 with downward-pointing flex-resistant rods 18 (FIG. 3). It is important that the manufacturing assemblies run continuously, which is also true when using profile elements 17 and the application of the frame forming the side walls of the trough. The aforementioned manufacturing process for troughs 10B e.g. corresponding to FIG. 3, right half, then can be carried out by a device which suffices for the manufacture of fully assembled structural elements filled with filler material, e.g. fluid anhydrite, in the already protected manner. The filled trough could then still be transported through a continuous furnace or the like, in which the filled material is hardened more rapidly. The troughs however could also not be filled with filler material until on the construction site, e.g. from on-site concrete from a portable concrete mixer.

The manufacturing assembly shown in FIG. 9 for trough-shaped sheet metal profile elements 17 to make trough floors 14 corresponds essentially to that of FIG. 7, with the exception that here the funnel-shaped holes 13 are made in the floor of the trough-shaped profile by two turning rollers 43, 44, between which runs the trough-shaped profile. The one, e.g. top roller 43, is provided with preferably exchangeable pins 45, while the other, bottom roller 44, has depressions 46, which cooperate with pins 45 while the rollers are turning. With turnin rollers 43 and 44, pins 45 penetrate into the trough-shaped profile, moving in the direction of the arrow, and produce holes 13, as shown diagrammatically in FIG. 10.

The armatures for transfer of the horizontal forces in the area between trough floor and pressure-resistant filler material could also consist of granular material, e.g., quartz sand, which adheres to the inside of the trough floor by means of an adhesive (preferably in fire-resistant composition).

What is claimed is:

1. Process for the continuous manufacture of troughs as outside reinforcement for cantilevered composite structure plates characterized by the following steps:

(a) continuously roll deforming a trough-shaped profile having a floor and side shanks on an elongated rolled out, strong strip material;

(b) continuously impressing holes at least in its floor during the longitudinal movement of the trough-shaped profile, with funnel-shaped edges projecting over the future inside of the trough;

(c) with continuous longitudinal movement of the trough-shaped profile, gluing a foil, drawn on the future outside of the trough, closing the holes;

(d) then cutting off from the trough-shaped profile trough-shaped elements of the length of the desired composite structure plate during continuous longitudinal movement of the profile;

(e) forming a trough floor from one or a plurality of cut lengths of the trough-shaped profile elements having outwardly extending flex-resistant ribs, wherein when said trough floor is formed from a plurality of trough-shaped profile elements, said elements are connected first with each other on their downward-pointing shanks which meet each other; and (f) connecting the one element or plural elements trough floor with a frame forming the side walls of the trough.

2. Process for the continuous manufacture of troughs of a material with high tensile strength and high elasticity modulus as outside reinforcement for cantilevered composite structure plates with a filler material of low tensile strength and low elasticity modulus, and also with sliding armatures in the trough floor in the form of holes which have funnel-shaped edges projecting over the inside of the trough, characterized by the following steps:

(a) continuously roll deforming a trough-shaped profile having a floor and side shanks on an elongated rolled-out strip material;

(b) continuously impressing holes with funnel-shaped edges projecting over the future inside of the trough, during the longitudinal movement of the trough-shaped profile, at least in its floor;

(c) with continuous longitudinal movement of the trough-shaped profile, gluing a matallic foil, drawn from a roll, on the future outside of the trough to close the holes therein;

(d) with continuous longitudinal movement of the profile, separating from the trough-shaped profile trough-shaped pieces of the lengths of the desired composite structure plate;

(e) forming a trough floor from one or a plurality of lengths the trough-shaped profile pieces having outwardly extending flex-resistant ribs of the composite structure plate, wherein when said trough floor is formed from a plurality of trough-shaped profile pieces, said pieces are connected compactly with each other on their shanks which project downward, engaging on each other, e.g. by rolled seam or point welding, screwing or riveting; and, (f) connecting the one or plurality of pieces trough floor by rolled seam or point welding, screwing or riveting with a frame forming the side walls of the trough.

* * * * *